US010240901B1

(12) United States Patent
Cheng

(10) Patent No.: US 10,240,901 B1
(45) Date of Patent: Mar. 26, 2019

(54) QUICK RELEASE MOUNTING DEVICE FOR M-LOK HANDGUARD OF RIFLE

(71) Applicant: Chung-Tien Cheng, Milton, GA (US)

(72) Inventor: Chung-Tien Cheng, Milton, GA (US)

( * ) Notice: Subject to any disclaimer, the term of this patent is extended or adjusted under 35 U.S.C. 154(b) by 0 days.

(21) Appl. No.: 15/925,139

(22) Filed: Mar. 19, 2018

(51) Int. Cl.
*F41G 11/00* (2006.01)
*F41A 35/00* (2006.01)
*F41C 27/00* (2006.01)

(52) U.S. Cl.
CPC ..... *F41G 11/003* (2013.01); *F41A 35/00* (2013.01); *F41C 27/00* (2013.01)

(58) Field of Classification Search
CPC ..... F41C 27/00; F41C 23/16; F41G 11/04
USPC ..... 42/90
See application file for complete search history.

(56) References Cited

U.S. PATENT DOCUMENTS 5,590,484 A 1/1997 Mooney et al.
7,140,143 B1 11/2006 Ivey
8,371,056 B1 2/2013 Baker et al.
8,752,320 B2 6/2014 Masters
9,151,575 B2 10/2015 Pereira
9,157,696 B2 10/2015 Dextraze
9,228,798 B1 1/2016 Viola
9,239,208 B2 1/2016 Miller et al.
9,404,714 B2 8/2016 Langevin et al.
9,599,437 B2 3/2017 Eble
9,618,299 B1 4/2017 Gingrich
9,777,985 B2 * 10/2017 Roberts ..... F41G 11/001
9,835,411 B2 12/2017 Larson, Jr. et al.
9,857,146 B1 1/2018 Shelton et al.
9,964,380 B1 * 5/2018 Oglesby ..... F41C 27/00
2016/0209175 A1 7/2016 Sharron et al.
2016/0349011 A1 * 12/2016 Jen ..... F41G 11/001
2018/0053607 A1 * 2/2018 McCauley ..... H01H 9/02

* cited by examiner

*Primary Examiner* — J. Woodrow Eldred
(74) *Attorney, Agent, or Firm* — Baker Donelson, Bearman, Caldwell & Berkowitz, PC; Dorian Kennedy

(57) ABSTRACT

The mounting device includes keys or pressing element, a movable fastener, a positioning bar and elastic elements, which are assembled in a receiving room of a base. The base is formed with an island type engagement portion having a shape corresponding to a slot of an M-LOK rail. The keys or pressing element is transversely movable in the receiving room. The movable fastener is longitudinally movable in the receiving room and has a latch bar projecting to a bottom of the island type engagement portion. The keys or pressing element and the movable fastener are provided with a driving slant and a driven slant, respectively. A slidable planar contact is formed between the driving slant and the driven slant by means of both the driven slant being shifted by pushing the driving slant and elasticity of the elastic elements. Pressing the keys or pressing element drives the latch bar to make a longitudinally to-and-fro shift.

2 Claims, 9 Drawing Sheets

QUICK RELEASE MOUNTING DEVICE FOR M-LOK HANDGUARD OF RIFLE

BACKGROUND OF THE INVENTION

1. Technical Field

The invention relates to quick release mounting device for accessories of guns, particularly to a mounting device which can be rapidly assembled to or disassembled from the M-LOK handguard of a rifle.

2. Related Art

Usually, firearms are mounted with various accessories for convenient operation, including but not limited to optical scope, bipod, light or laser target pointer. Such accessories can be attached or detached to the handguard of a firearm. Currently, among the firearm rail systems for attaching accessories on a firearm, the M-LOK (Modular Lock) framework is the most popular to be adopted because M-LOK system can be effectively by its reduced in weight, increasing portability and operability for users. The Conventional M-LOK accessory mounting devices are equipped with a T-slot nut on the bottom of a base of the mounting device. When assembling, the T-slot nut is inserted into a slot in the handguard, rotated 90 degrees and then a screw is tightened to lock the T-slot nut in the 90 degree position. As a result, the T-slot nut will engage with edges of the slot to firmly attach an accessory. Such a conventional accessory mounting device needs tools to fasten, so that assembling and disassembling of accessories may or may not require removing all or a portion of the M-LOK rail system which is both time-consuming and complicated.

There is a mounting device which enables users to rapidly and reliably assemble or disassemble an accessory such as a target pointer or light to or from the MAGPUL® M-LOK rail of a firearm. Such a mounting device includes a lock mechanism having a release bar and at least one spring and wedge. Because the release bar is arranged at two longitudinal edges of a main body of the mounting device, for the sake of easy operation, the main body of the mounting device is limited in length. As a result, the accessories which are applicable to this mounting device are also limited. Additionally, when an accessory is being removed from this mounting device, a user's fingers must touch the release bars. However, it is hard to operate because the space is limited.

SUMMARY OF THE INVENTION

The objective of the invention is to provide a quick release mounting device for an M-LOK handguard of rifle, which enables users to rapidly and reliably assemble or disassemble an accessory to or from a M-LOK rail of a firearm without tools by one hand and allows the other hand to be capable of holding, manipulating and or operating the firearm to increase quick response and operating ability on the spot.

To accomplish the above objective, the invention includes a base, a cover, two movable fasteners, two positioning guide bars, two keys or pressing elements and a plurality of elastic elements.

The bottom of the base is downward formed with a protruding island type engagement portion and a guide trough along a longitudinal central line of the protruding island type engagement portion. The base 1 has a receiving room over the protruding island type engagement portion. Each of two short side walls of the receiving room is formed with an opening and each of two long side walls of the receiving room is formed with a guide cavity. The center of the receiving room is formed with a central post. Two guide channels are separately formed to extend from the central post toward two opposite ends. The guide channels penetrate the bottom of the receiving room to communicate with the guide trough of the protruding island type engagement portion. The protruding island type engagement of the two moveable fasteners possesses a shape corresponding to a slot of an M-LOK rail and a size dimension which is slightly less than the slot.

A surface of the cover is a Picatinny rail which allows attaching or mounting various accessories. The middle of each of two sides of the cover is formed with a recess for adding a press operating space of the two keys or pressing elements. The cover is fixed to the base by connecting elements to form an integrated body. The connecting elements are screws.

The movable fastener has an upright portion and a horizontal portion, which are connected to form an integrated body. The upright portion has two driven slants, a guide bar and a first receiving hole. The guide bar horizontally extends between the two driven slants for being movably inserted into the guide cavity. The first receiving hole is located at a corresponding side between the two driven slants. The horizontal portion of the movable fastener is a latch bar which is movably received in the guide channel and the guide trough. The front end of the latch bar is formed with a slope which gradually rises from the front end to a rear end.

The positioning bar has a head having a larger diameter. A lower end of the positioning bar is a wedge tapering off downward. The two positioning bars are separately received in two guide holes. A part of the wedge protrudes from an edge of the protruding type engagement portion to compensate gaps between these two components. The head is further formed with at least one trimmed side. When the positioning bars are inserted into the guide holes, the trimmed side of the head just abuts against a side wall of the receiving room to prevent the positioning bars 4 from rotating and shifting.

The pressing elements are movably received in the receiving room. An operating end of each pressing element exposedly protrudes from a lateral side of the base through the opening. Preferably, the operating end is formed with an anti-slip pattern. The pressing element has two driving slants, a third receiving hole and two limiting blockers. Each driving slant has an incline corresponding to the driven slant so that a smoothly and slidably planar contact can be formed between the driving slant and the driven slant. The two limiting blockers push two side walls of the opening to limit outward shift of the pressing elements.

The elastic elements include a first elastic element, a second elastic element and a third elastic element. An end of the first elastic element is received in the first receiving hole, and the other end thereof pushes the central post to provide an outward pushing force to the movable fasteners. The second elastic element is disposed on the head of the positioning bar to provide a downward pressure to the positioning bar. An end of the third elastic element is received in the third receiving hole, and the other end thereof pushes the central post to provide an outward pushing force to the pressing elements.

Accordingly, a smoothly and slidably planar contact is formed between the driving slant and the driven slant. Pressing the keys or pressing elements can control to-and-fro shifts of the latch bar toward two opposite ends to make assembling or disassembling between the mounting device of the invention and the M-LOK rail easy and rapid capable of being operated with one hand, without the use of any tools. Also, the assembly attaches firmly preventing unintended movement while installed.

DETAILED DESCRIPTION OF THE INVENTION

Figure 10:
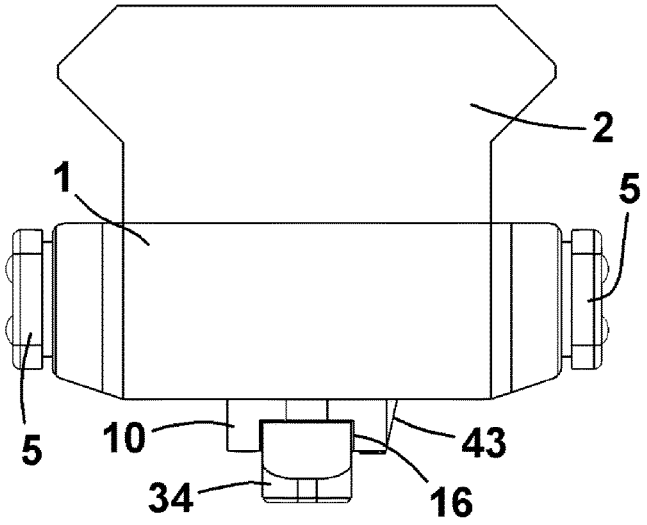
FIG. 10 is a schematic view of an end of an embodiment of the invention, which shows the positioning bar 4 is not embedded into the slot 9 of the M-LOK rail yet, and a portion of a wedge 43 at a lower end of the positioning bar 4 protrudes from an edge of the protruding type engagement portion 10.
Figure 11:
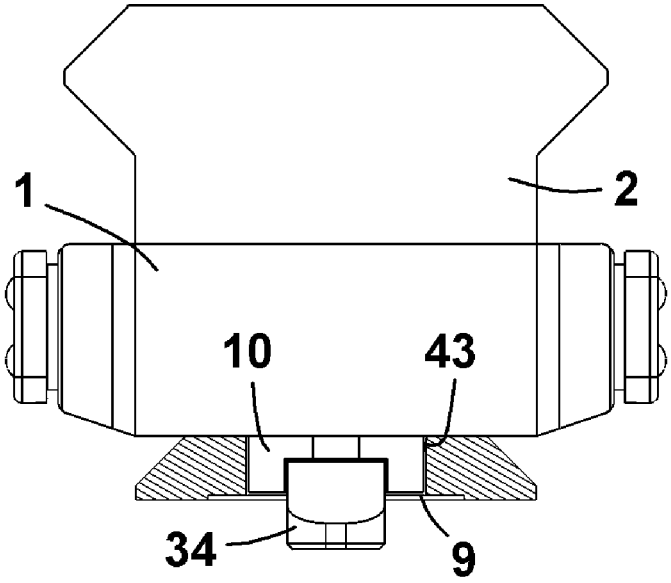
FIG. 11 is a schematic view of an end of an embodiment of the invention, which shows the positioning bar 4 has been embedded into the slot 9 of the M-LOK rail, and a protrudent portion of the wedge 43 at the lower end of the positioning bar 4 abuts against the edge of the slot 9.
Figure 12:
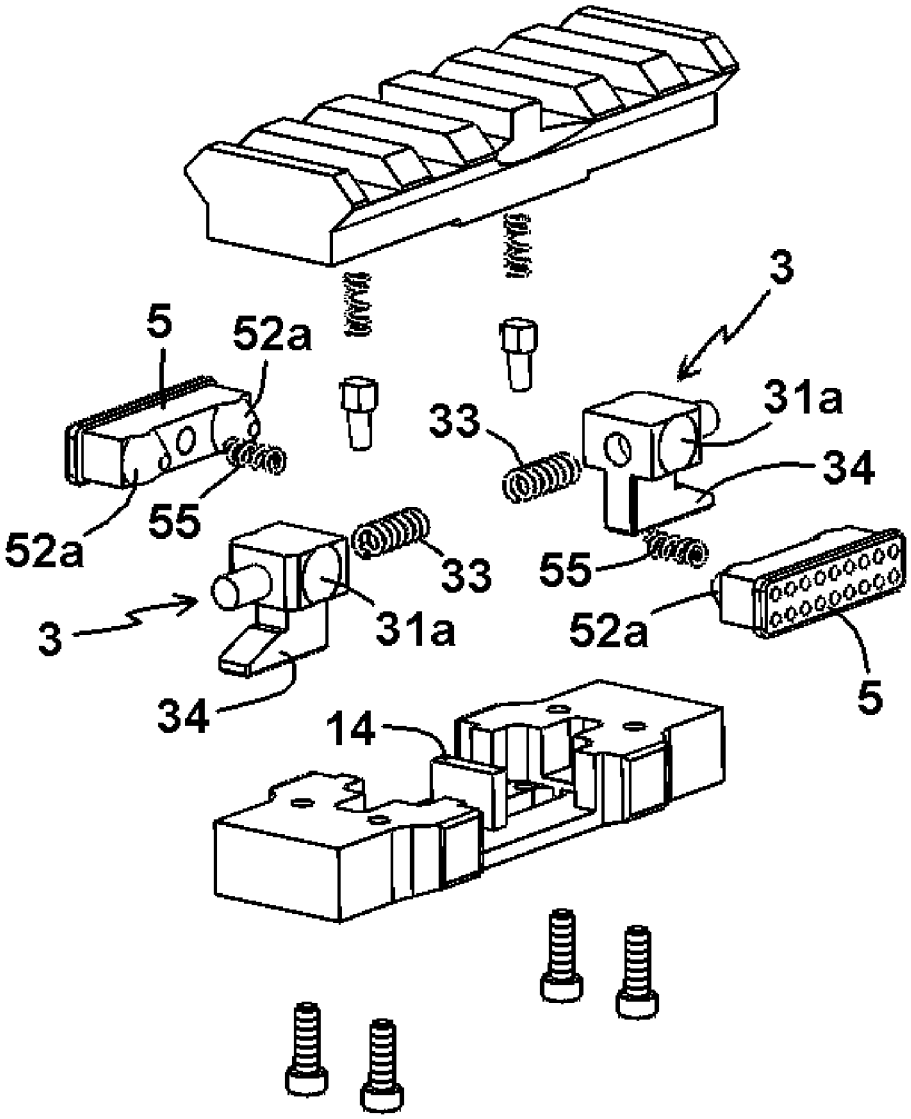
FIG. 12 is an exploded view of the second embodiment of the invention.
Figure 13:
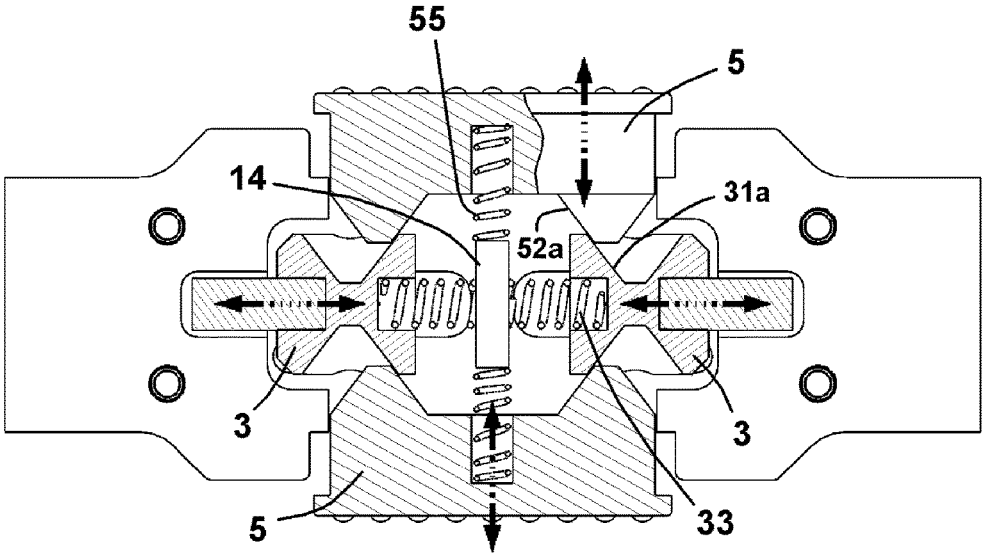
FIG. 13 is a top view of the second embodiment of the invention.
Figure 14:
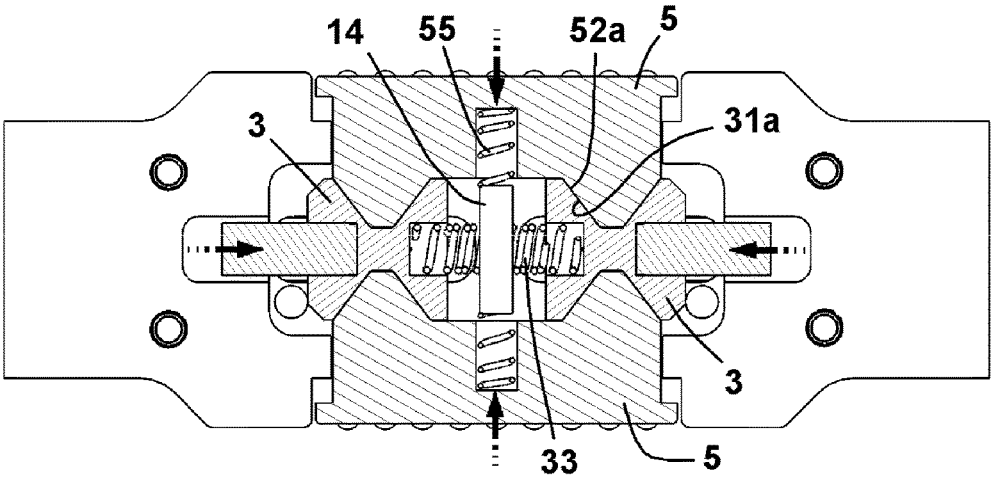
FIG. 14 is a top view of the second embodiment of the invention, which shows pressing the keys or pressing element 5 to make the two movable fasteners 3 shift toward the central post 14.

The invention is now described with reference to the drawings, FIGS. 1-11 depict the first embodiment of the invention and FIGS. 12-14 depict the second embodiment of the invention, wherein like reference numerals are used to refer to like elements throughout. In the following description, for purposes of explanation, numerous specific details are set forth in order to provide a thorough understanding thereof. It may be evident, however, that the invention can be practiced with or without these specific details.

Please refer to FIGS. 1-4. The quick release mounting device for an M-LOK handguard of the first embodiment of the invention is comprised of a base 1, a cover 2, two movable fasteners 3, two positioning bars 4, two keys or pressing element 5 and a plurality of springs. The bottom of the base 1 is downward formed with a protruding island type engagement portion 10 and a guide trough 11 along a longitudinal central line of the protruding island type engagement portion 10. The protruding island type engagement portion 10 possesses a shape corresponding to a slot 9 of an M-LOK rail and a size dimension which is slightly less than the slot 9 so as to make the protruding island type engagement portion 10 be able to smoothly be embedded into the slot 9. The base 1 has a rectangular receiving room 12 over the protruding type engagement portion 10. Each of two short side walls of the receiving room 12 is formed with an opening 13 and each of two long side walls of the receiving room 12 is formed with a guide cavity 18. The center of the receiving room 12 is formed with a central post 14. Two guide channels 16 are separately formed to extend from the central post 14 toward two opposite ends. The guide channels 16 penetrate the bottom of the receiving room 12 to communicate with the guide trough 11 of the protruding type engagement portion 10.

A surface of the cover 2 is a Picatinny rail 21 which allows attaching or mounting various accessories. The middle of each of two sides of the cover 2 is formed with a recessed feature 22 for adding a press operating space of the two keys or pressing element 5. The cover 2 is fixed to the base 1 by screws 25 to form an integrated body.

Figure 5:
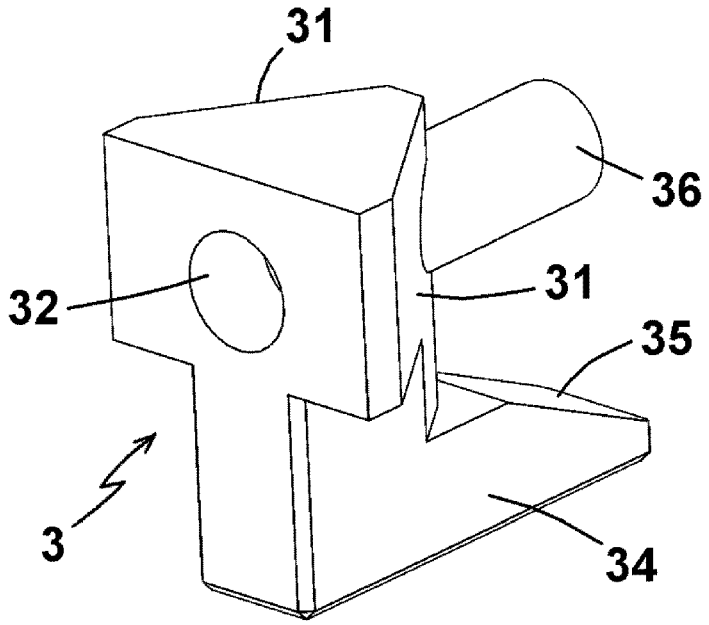
FIG. 5 is a perspective view of the movable fastener of an embodiment of the invention.

As shown in FIG. 5, the movable fastener 3 has an upright portion and a horizontal portion, which are connected to form an integrated body. The upright portion has two driven slants 31, a positioning guide bar 36 and a receiving hole 32. The positioning guide bar 36 horizontally extends between the two driven slants 31 for being movably inserted into the guide cavity 18 of the base 1. The receiving hole 32 is located at a corresponding side between the two driven slants 31 for receiving a compression spring 33. The horizontal portion of the movable fastener 3 is a latch bar 34 which is movably received in the guide channel 16 and the guide trough 11 of the base 1. A front end of the latch bar 34 is formed with a slope 35 which gradually rises from the front end to a rear end so that the latch bar 34 can smoothly slide into a bottom edge of the slot 9 of the M-LOK rail for connecting and engaging the latch bar 34 with the M-LOK rail. An end of the compression spring 33 is accommodated in the receiving hole 32, and the other end thereof pushes the central post 14. As a result, by the elasticity of the compression spring 33, the movable fastener 3 is normally outward pushed.

Figure 1:
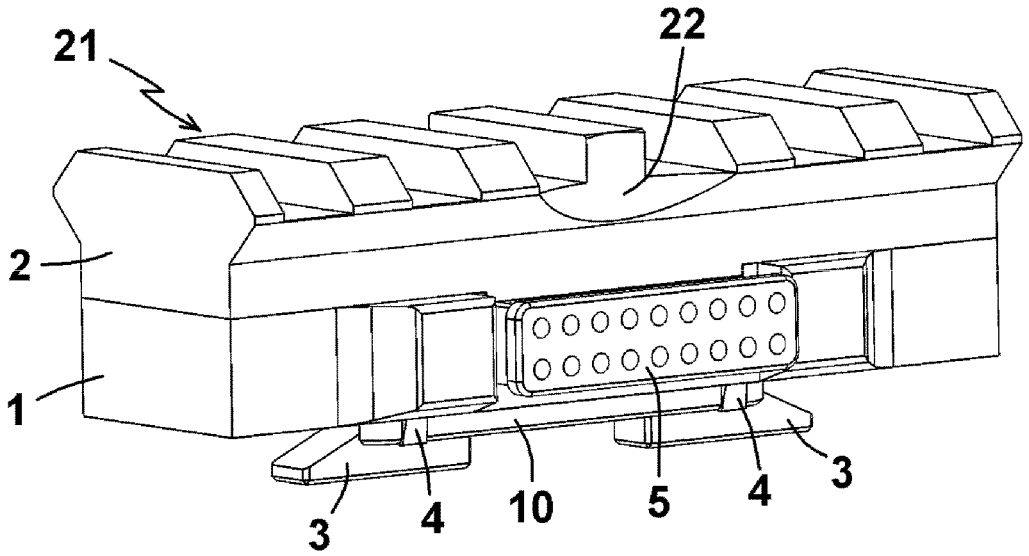
FIG. 1 is a perspective view of a preferred embodiment of the invention.
Figure 2:
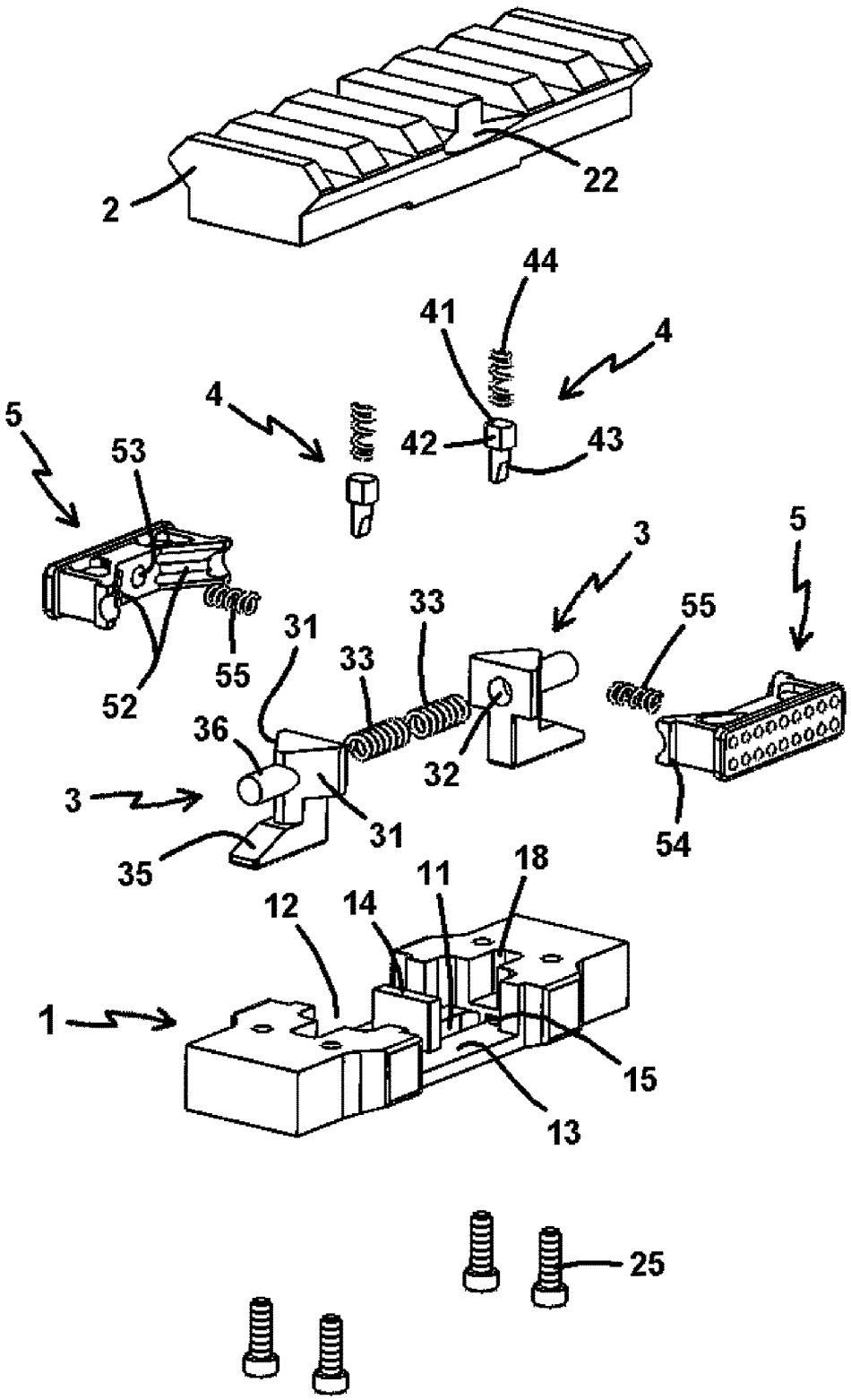
FIG. 2 is an exploded perspective view of an embodiment of the invention.
Figure 3:
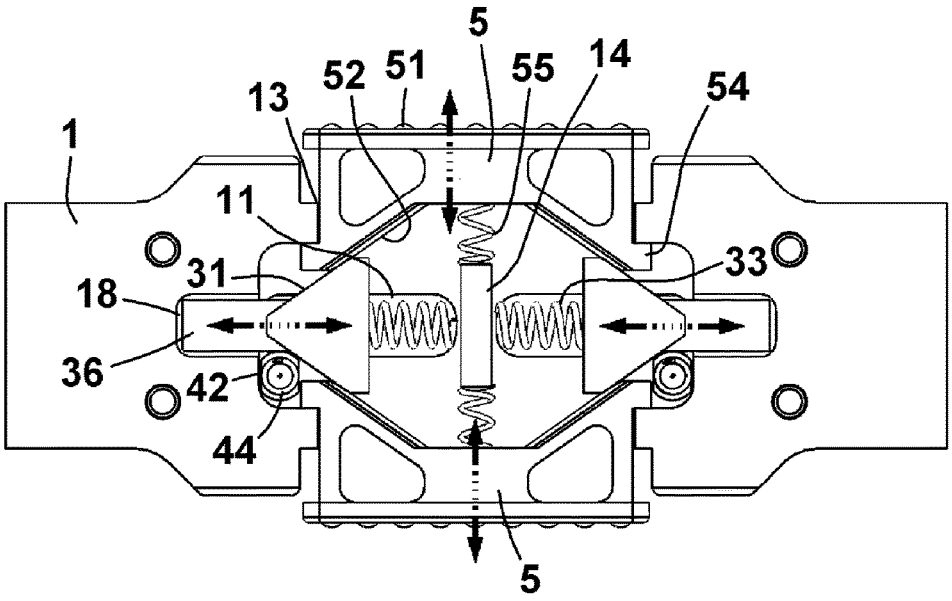
FIG. 3 is a top view of an embodiment of the invention in an assembled status.

The positioning bar 4 has a head 41 having a larger diameter. The head 41 is formed with at least one trimmed side 42. A lower end of the positioning bar 4 is a wedge 43 tapering off downward. The two positioning bars 4 are separately received in two guide holes 15 of the base 1. The guide holes 15 are located outside the protruding island type engagement portion 10. When the positioning guide bars 4 are inserted into the guide holes 15, the trimmed side 42 of the head 41 just abuts against a side wall of the receiving room 12 as shown in FIG. 3 to prevent the positioning guide bars 4 from rotating and shifting. A compression spring 44 is disposed on the head 41 to exert a downward pressure. As a result, as shown in FIGS. 10 and 11, when the invention is assembled with an M-LOK rail and the protruding island type engagement portion 10 is embedded into the slot 9 of the M-LOK rail, the pressure of the compression spring 44 makes the positioning bar 4 move downward and a part of the wedge 43 of the positioning bar 4 protrudes from an edge of the protruding type engagement portion 10. The protrudent part of the wedge 43 will closely abut against edges of the slot 9 to compensate gaps between these two components to increase firmness of connection.

The keys or pressing element 5 are movably received in the receiving room 12. An operating end 51 of each key or pressing element 5 exposedly protrudes from a lateral side of the base 1 through the opening 13. The operating end 51 is formed with an anti-slip pattern such as small protrusions, dimples, ridges, raised or recessed lines to prevent fingers from skidding or slipping. The key or pressing element 5 has two driving slants 52, a receiving hole 53 and two limiting blockers 54. Each driving slant 52 has an incline corresponding to the driven slant 31 of the movable fastener 3 so that a smoothly and slidably planar contact can be formed between the driving slant 52 and the driven slant 31. A compression spring 55 is received in the receiving hole 53. An end of the compression spring 55 is received in the receiving hole 53 and the end thereof pushes the central post 14. As a result, by the elasticity of the compression spring 55, the keys 5 are outward pushed to make the operating end 51 normally protrude from a lateral side of the base 1. Also, the two limiting blockers 54 pushes two side walls of the opening 13 to limit outward shift of the keys or pressing element 5 to prevent the keys or pressing element 5 from escaping from the opening 13.

As abovementioned, the movable fasteners 3, positioning bars 4, keys or pressing element 5 and springs are assembled in the receiving room 12 of the base 1. The cover 2 is fixed to the base 1 by screws 25 to form an integrated body. The operating end 51 of the key or pressing element 5 exposedly protrudes from two lateral sides of the base 1 to be convenient to a press operation. That is, a user may simply use one hand to press the key or pressing element 5 to rapidly and accurately attach the mounting device of the invention to the M-LOK rail.

Figure 6:
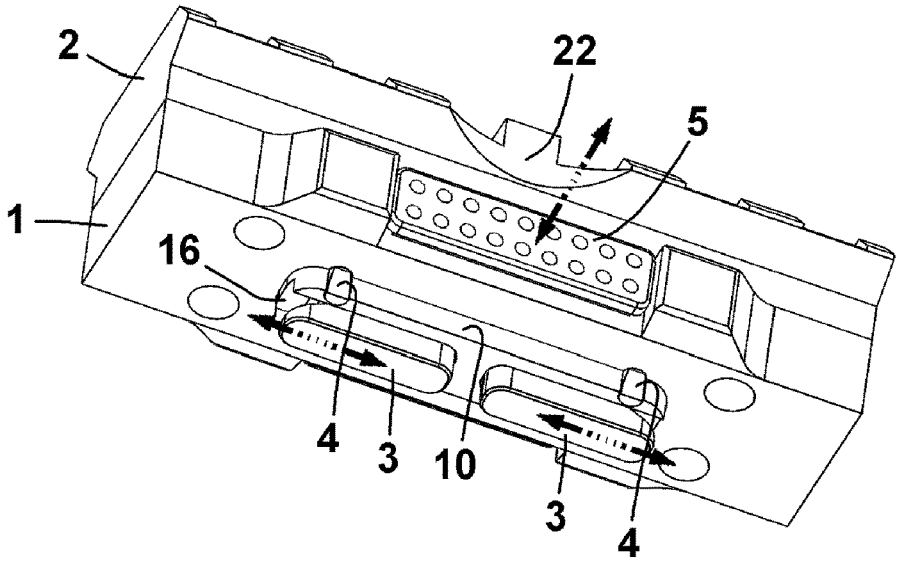
FIG. 6 is a bottom perspective view of an embodiment of the invention, which shows pressing the key or pressing element 5 to make the latch bar 34 of the movable fastener retract into the protruding island type engagement portion 10 along the guide trough 11.
Figure 7:
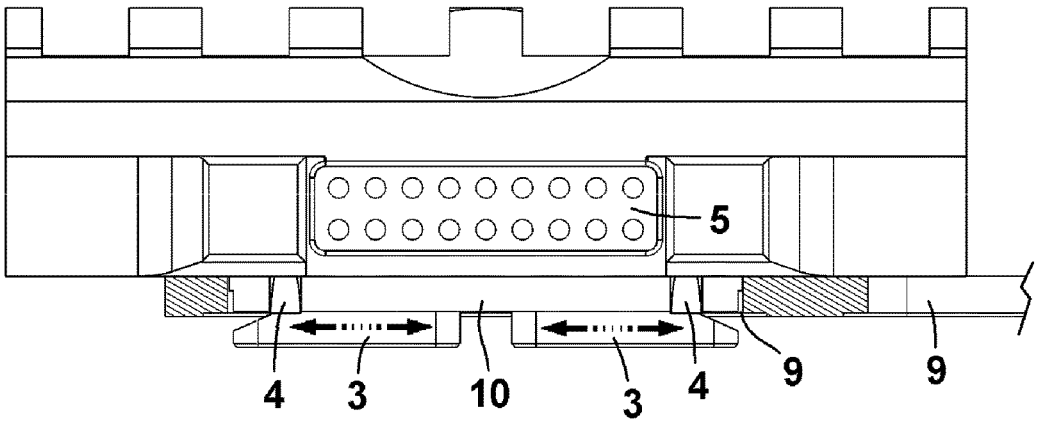
FIG. 7 is a side view of FIG. 6.

The assembling and operation of the invention and M-LOK rail will be further described below. Please refer to FIGS. 6-9. The driving slant 52 of the key or pressing element 5 abuts against the driven slant 31 of the movable fastener 3 as shown in FIG. 3, so when a user presses the key or pressing element 5, the key or pressing element 5 shifts toward the inside of the receiving room 12 to make the driving slant 52 push and move the driven slant 31, and two movable fasteners 3 separately shift inward toward the central post 14. Meanwhile, the originally protrudent latch bar 34 retracts into the protruding type engagement portion 10 along the guide trough 11 as shown in FIGS. 6, 7 and 10. As a result, the protruding type engagement portion 10 can be smoothly embedded into the slot 9 of the M-LOK rail.

Figure 4:
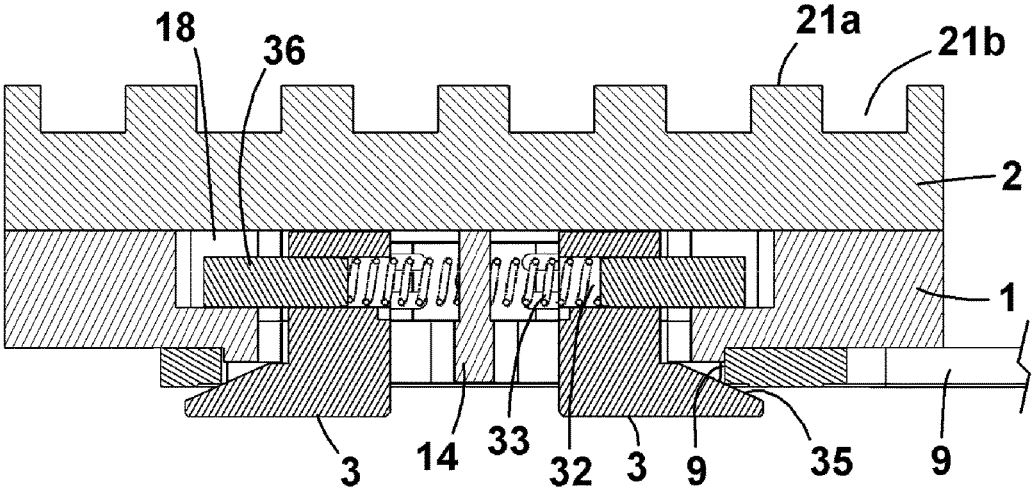
FIG. 4 is a cross-sectional view of an embodiment of the invention in an assembled status.
Figure 8:
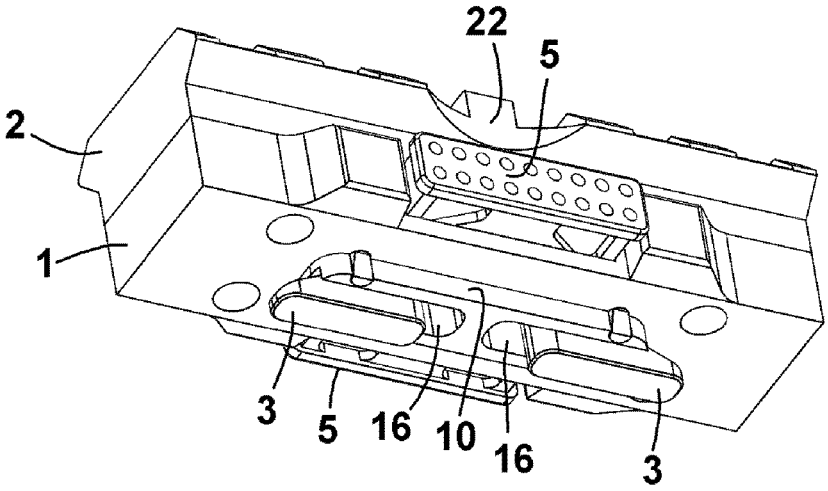
FIG. 8 is another bottom perspective view of an embodiment of the invention, which shows releasing the keys or pressing element 5 to make the latch bar 34 shift outward along the guide trough 11, and a front end of the latch bar 34 protrudes from the protruding type engagement portion 10 and engages with the slot 9 of the M-LOK rail.
Figure 9:
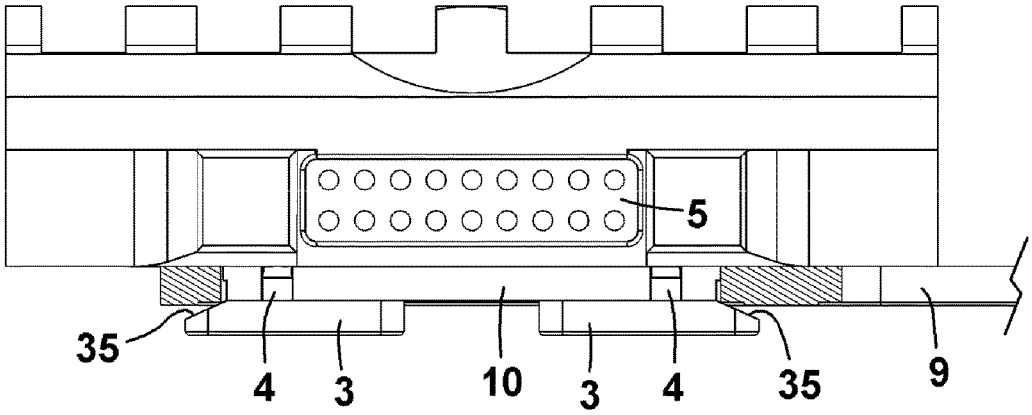
FIG. 9 is a side view of FIG. 8.

When a user releases the key 5, the key 5 is moved outward by the compression spring 55, two movable fasteners 3 are separately moved away from the central post 14 by the compression spring 33, the guide bar 36 moves outward along the guide cavity 18 of the base 1, and the latch bar 34 moves outward along the guide trough 11. A front end face 35 of the latch bar 34 protrudes from the protruding type engagement portion 10 and engages with the bottom of longitudinal edges of the slot 9 of the M-LOK rail to make firm fixing between the invention and the M-LOK rail as shown in FIGS. 4, 8 and 9. In addition, the wedges 43 of the positioning bars 4 closely abut against short edges of the slot 9 to enhance stability of engagement as shown in FIGS. 10 and 11. Particularly, the torque generated by the latch bar 34 pushing edges of the slot 9 can be offset by the guide bar 36 pushing the bottom wall of the guide cavity 18 as shown in FIG. 4.

Contrarily, when the invention will be removed from the M-LOK rail, simply pressing the key or pressing element 5 can make the base 1 rapidly escape from the slot 9. The details will be described below. When a user presses the key or pressing element 5, the key or pressing element 5 shifts toward the inside of the receiving room 12, the driving slant 52 pushes and moves the driven slant 31, and two movable fasteners 3 separately shift toward the central post 14. Meanwhile, the latch bar 34 retracts into the protruding island type engagement portion 10 along the guide trough 11 as shown in FIGS. 6, 7 and 10. As a result, the protruding type engagement portion 10 can smoothly escape from the slot 9 of the M-LOK rail. It is noted that the positioning bar 4 utilizes the wedge 43 to closely abut against short edges of the slot 9, so it will not impede the removing operation of the base 1 at all.

FIGS. 12-14 depict features of the second embodiment of the invention. The second embodiment is substantially identical to the abovementioned first embodiment. The differences between them are two concave conical surfaces 31*a* which replace the original driven slants 31 of the movable fastener 3 and two convex conical surfaces 52*a* which replace the original driving slants 52 of the key or pressing element 5. The concave conical surface 31*a* is the same as the convex conical surface 52*a* in taper, so that a smoothly and slidably surface contact may be formed between them. As a result, when a user presses the key or pressing element 5, the key or pressing element 5 shifts inward to make the convex conical surface 52*a* push and move the concave conical surface 31*a*, and two movable fasteners 3 separately shift toward the central post 14 as shown in FIG. 12. When a user releases the key or pressing element 5, the key or pressing element 5 is moved outward by the compression spring 55, two movable fasteners 3 are separately moved away from the central post 14 by the compression spring 33 as shown in FIG. 11. As a result, pressing the key or pressing element 5 can drive the latch bar 34 to make a longitudinal to-and-fro shift to make assembling or disassembling between the mounting device of the invention and the M-LOK rail occur.

In sum, the two embodiments of the invention are able to utilize pressing the key 5 to control to-and-fro shifts of the latch bar 34 toward two opposite ends to make assembling or disassembling between the mounting device of the invention and the M-LOK rail. It is easy and rapid in operation and is capable of using one hand not require or use any tools. Also, the accessory attaches firmly and does not fall off.

Preferred embodiments of this invention are described herein. Variations of those preferred embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A quick release mounting device for a firearm rail, comprising a pressing element, movable fasteners, a positioning bar, and elastic elements coupled to the pressing elements, the pressing element, movable fasteners, positioning bar and elastic elements being positioned within a receiving room of a base, a cover fixed to the base by connecting elements to form an integrated body, a bottom of the base is formed with a protruding engagement portion having a shape corresponding to a slot of a firearm rail, the pressing element is mounted within the receiving room for movement along a first direction, the pressing element has an operating end protruding from a lateral side of the base, each movable fasteners is movably disposed in the receiving room for movement along a second direction transverse to the first direction of the pressing element, each movable fastener has a latch bar projecting through a bottom of the protruding engagement portion, the pressing element is provided with a driving slant, each movable fastener is provided with a driven slant, a slidable contact is formed between the driving slant and the driven slant for driving each movable fasteners in the second direction of the movably fastener, whereby pressing the pressing element in the first direction against the biasing force of the elastic elements drives the latch bar of each movable fastener in a second direction transverse to the first direction.

2. The mounting device of claim 1, wherein the driving slant is a convex conical surface and the driven slant is a concave conical surface.

* * * * *